US009624747B2

(12) United States Patent
Kajaria et al.

(10) Patent No.: US 9,624,747 B2
(45) Date of Patent: Apr. 18, 2017

(54) TENSION TUBING HANGER AND METHOD OF APPLYING TENSION TO PRODUCTION TUBING

(71) Applicant: GE Oil & Gas Pressure Control LP, Houston, TX (US)

(72) Inventors: Saurabh Kajaria, Houston, TX (US); Khang V. Nguyen, Houston, TX (US); Eugene A. Borak, Tomball, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 626 days.

(21) Appl. No.: 14/066,116

(22) Filed: Oct. 29, 2013

(65) Prior Publication Data

US 2014/0151069 A1 Jun. 5, 2014

Related U.S. Application Data

(60) Provisional application No. 61/726,798, filed on Nov. 15, 2012.

(51) Int. Cl.
*E21B 33/04* (2006.01)
*E21B 33/047* (2006.01)

(52) U.S. Cl.
CPC ..... *E21B 33/0415* (2013.01); *E21B 33/047* (2013.01)

(58) Field of Classification Search
CPC ..... E21B 33/047; E21B 33/0415
See application file for complete search history.

(56) References Cited

U.S. PATENT DOCUMENTS 4,181,175 A 1/1980 Bridges et al.
4,258,792 A * 3/1981 Restarick ..... E21B 17/07 166/242.1
4,501,441 A * 2/1985 Crews ..... E21B 33/04 285/123.9

(Continued)

FOREIGN PATENT DOCUMENTS

GB 2057032 A 3/1981
GB 2108551 A 5/1983
GB 2307928 A 6/1997

OTHER PUBLICATIONS

International Search Report and Written Opinion issued in connection with corresponding Application No. PCT/US2013/069643 on Dec. 22, 2014.

(Continued)

*Primary Examiner* — David Andrews
(74) *Attorney, Agent, or Firm* — Hogan Lovells US LLP

(57) ABSTRACT

A tubing hanger assembly includes a tubular outer tubing hanger member adapted to land in a bore of a wellhead. A tubular inner tubing hanger member is adapted to be secured to a string of production tubing and has an engaged position in a bore of the outer tubing hanger member. A retaining mechanism selectively allows the inner tubing hanger member to be lowered relative to the outer tubing hanger member, then selectively allowing the inner tubing hanger member to be returned back to the engaged position, to create tension in the string of production tubing. The retaining mechanism operates in response to rotational movement of the inner tubing hanger member while the outer tubing hanger member remains stationary with the wellhead.

20 Claims, 6 Drawing Sheets

(56) References Cited

U.S. PATENT DOCUMENTS

| | | | | |
|---|---|---|---|---|
| 5,465,794 | A | 11/1995 | McConaughy et al. | |
| 6,415,863 | B1 | 7/2002 | Hudson et al. | |
| 8,291,986 | B2 | 10/2012 | Gorrara et al. | |
| 2011/0005774 | A1 | 1/2011 | Sinnott et al. | |
| 2011/0226488 | A1 | 9/2011 | Garcia | |
| 2013/0020095 | A1* | 1/2013 | Vanderford | E21B 23/00 166/382 |

OTHER PUBLICATIONS

PCT Invitation to Pay Fees issued from corresponding PCT Application No. PCT/US2013/069643 dated Oct. 17, 2014.

* cited by examiner

TENSION TUBING HANGER AND METHOD OF APPLYING TENSION TO PRODUCTION TUBING

CROSS REFERENCE TO RELATED APPLICATION

This application claims priority to and the benefit of U.S. Provisional Application Ser. No. 61/726,798 filed Nov. 15, 2012 the full disclosure of which is hereby incorporated by reference herein for all purposes.

BACKGROUND

1. Field of the Disclosure

This invention relates in general to wellhead assemblies and in particular to a tubing hanger assembly that maintains tension in a string of production tubing extending into a well.

2. Background

Some wells have completion strings with tubing that experiences thermal expansion over time. To compensate for the expansion, the tubing may be placed under tension. With sufficient tension, the expansion merely relaxes some of the tension. The travel distance associated with the expansion is less than the distance the tubing was stretched during the tensioning. Thus, even when the tubing expands over time, the tubing does not buckle within the wellbore.

It is often desirable to provide for a fluid supply line that will extend into the well. Certain existing tubing tensioning arrangements prevent the use of a fluid supply line that will descend through and below the tubing hanger. For example, the geometry of the well below the tubing hanger will provide for a fluid line fitting that is located at a predetermined distance from the axis of the inner bore of the wellhead. Certain existing tensioning arrangements do not allow for a fluid passage through the tubing hanger that can communicate with the fluid line fitting below the tubing hanger.

SUMMARY OF THE DISCLOSURE

Disclosed herein are embodiments of a system and method for applying tension to production tubing that also allows for a fluid passage through the tubing hanger assembly that can connect to a fluid supply line that will extend below the wellhead and into the well.

A tubing hanger assembly in accordance with an embodiment of this disclosure includes a tubular outer tubing hanger member adapted to land in a bore of a wellhead. The outer tubing hanger member has a bore with an axis. A tubular inner tubing hanger member has an engaged position in the bore of the outer tubing hanger member. The inner tubing hanger member is adapted to be secured to a string of production tubing. A retaining mechanism is mounted to the outer tubing hanger member and the inner tubing hanger member for selectively allowing the inner tubing hanger member to be lowered relative to the outer tubing hanger member, after the inner tubing hanger member is moved from the engaged position to a disengaged position, then selectively allowing the inner tubing hanger member to be returned back to the engaged position, to create tension in the string of production tubing. The retaining mechanism operates in response to rotational movement of the inner tubing hanger member while the outer tubing hanger member remains stationary with the wellhead.

In an alternative embodiment of the current disclosure, a wellhead assembly includes a tubular wellhead with a bore, a sidewall, and a fluid passage through the sidewall. A tubular outer tubing hanger member is landed in the bore of the wellhead. The outer tubing hanger member has a bore with an axis. A tubular inner tubing hanger member has an engaged position in the bore of the outer tubing hanger member. The inner tubing hanger member has a sidewall. A fluid passage extends axially within the sidewall of the tubular inner tubing hanger member in communication with the fluid passage of the wellhead for delivering fluids below the wellhead assembly. At least one shelf is in the bore of the outer tubing hanger member. The shelf extends less than a full circumference, defining a vertically extending slot. At least one flange is on the exterior of the inner tubing hanger member. The flange has a circumferential extent less than a circumferential extent of the slot. The inner tubing hanger member moves from an engaged position to an unengaged position allowing the inner tubing hanger member to be lowered axially relative to the outer tubing hanger member when the inner tubing hanger member is rotated in a first direction relative to the outer tubing hanger member. The inner tubing hanger is returned to the engaged position when the inner tubing hanger member is raised axially relative to the outer tubing and rotated in a second direction relative to the outer housing tubing member.

In yet another alternative embodiment of the current disclosure, a method for supporting production tubing includes positioning a tubular inner tubing hanger member in a bore of a tubular outer tubing hanger member in an engaged position to define a tubing hanger assembly. The tubing hanger assembly is landed in a bore of a wellhead. The inner tubing hanger member is rotated while the outer tubing hanger member remains stationary with the wellhead, to operate a retaining mechanism and move the inner tubing hanger from an engaged position to an unengaged position. The inner tubing hanger member is lowered relative to the outer tubing hanger member. The inner tubing hanger member is returned back to the engaged position, tensioning a string of production tubing that is secured to the inner tubing hanger member.

BRIEF DESCRIPTION OF THE DRAWINGS

Some of the features and benefits of the present invention having been stated, others will become apparent as the description proceeds when taken in conjunction with the accompanying drawings, in which.

DETAILED DESCRIPTION OF THE DISCLOSURE

Figure 1:
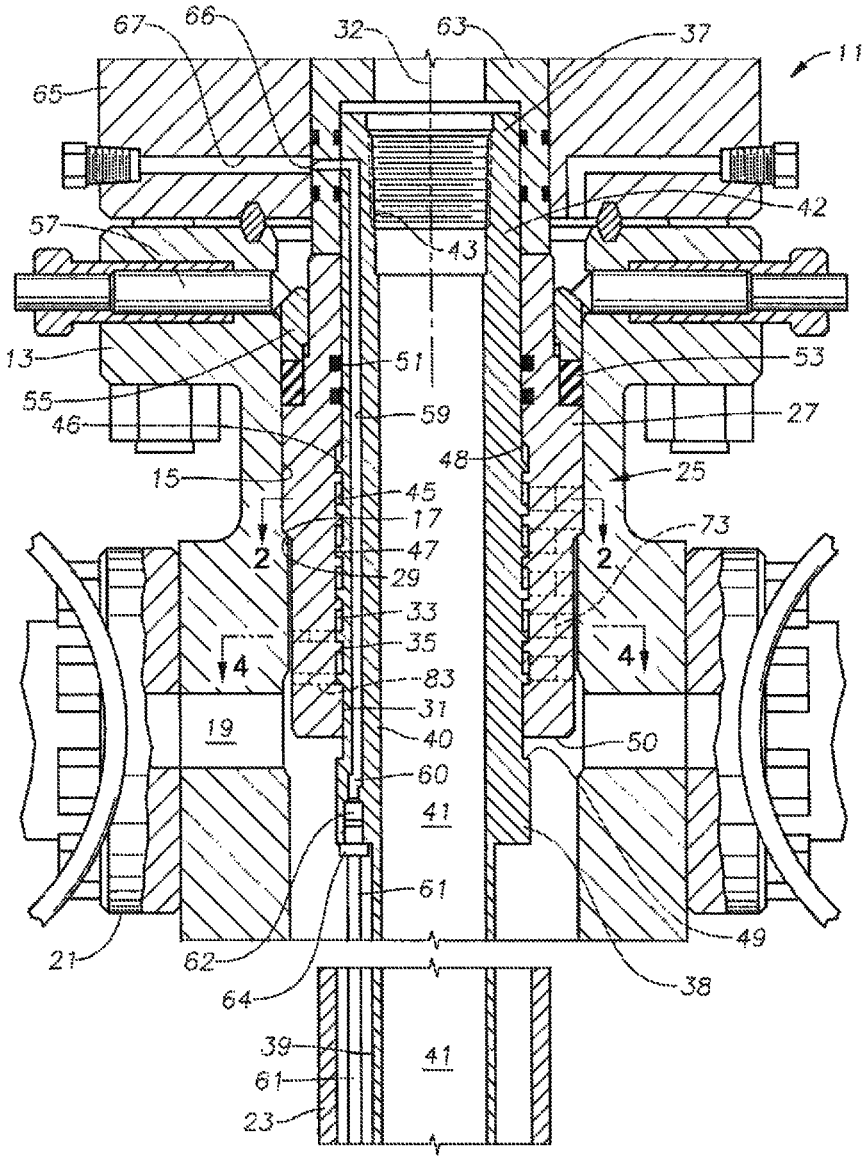
FIG. 1 is a vertical sectional view of a wellhead assembly having a tension tubing hanger assembly in accordance with this invention.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, wellhead assembly 11 includes a wellhead 13, which is a tubular member located at an upper end of a well. Wellhead 13 has a bore 15 with an upward-facing landing shoulder 17. Wellhead 13 also has flow ports 19 extending through its sidewall to valves 21. Normally, a surface string of casing (not shown) extends downward from wellhead 13. FIG. 1 shows a string of production casing 23 cemented in the well. Production casing 23 may be suspended in wellhead bore 15 in a conventional manner that is not shown. One of the flow ports 19 communicates with a casing annulus (not shown) between production casing 23 and a larger diameter string of casing in the well. The other flow port 19 communicates with the interior of production casing 23.

Tubing hanger assembly 25 lands in wellhead bore 15. Tubing hanger assembly 25 has an outer tubing hanger member 27 with a shoulder 29 than lands on landing shoulder 17. Outer tubing hanger member 27 has a bore 31 with a vertical axis 32. A number of horizontally extending grooves 33 are formed in bore 31. Grooves 33 extend circumferentially part way around bore 31, and each defines at least one shelf 35. Each shelf 35 has an upper surface that is flat and located in a plane perpendicular to axis 32. Shelves 35 are not helical and thus not part of a thread form. In the embodiment of FIG. 1, shelves 35 are shown on six planes perpendicular to axis 32. In other embodiments, fewer shelves 35 can be used.

An inner tubular tubing hanger member 37 is removably carried in bore 31 of outer tubing hanger member 27. Inner tubing hanger member 37 is secured to a production tubing string 39 that extends downward in production casing 23. Inner tubing hanger member 37 has a bore 41 that is aligned with vertical axis 32 and with the interior of production tubing string 39. Inner bore 41 defines a sidewall 40 of inner tubing hanger member 37, the sidewall 40 extending from the exterior of inner tubing hanger member 37 and inner bore 41. A profile that may be a set of threads 43 is formed in bore 41 near the upper end for connection to a running tool (not shown in FIG. 1).

Inner tubing hanger member 37 has a plurality of horizontally extending grooves 45 on its exterior. Each groove 45 extends part way around the exterior of inner tubing hanger member 37, defining at least one flange 47. While inner tubing hanger member 37 is in a landed or engaged position, as shown in FIG. 1, flanges 47 are supported on shelves 35, transferring the downward force imposed by production tubing string 39 to outer tubing hanger member 27 and wellhead 13. Shelves 35 and flanges 47 serve as a retaining mechanism to releasably hold inner tubing hanger member 37 in the engaged position. As will be explained subsequently, the retaining mechanism allows inner tubing hanger member 37 to move to a disengaged position by rotation of less than one turn. While in the disengaged position, inner tubing hanger member 37 can be lowered relative to outer tubing hanger member 27.

Referring still to FIG. 1, the uppermost flange 47 has a sloped upper surface 46. Outer tubing hanger member 27 has a corresponding stop shelf 48 with a sloped downward facing surface. Inner tubing hanger member 37 can be lifted relative to outer tubing hanger member 27 until sloped upper surface 46 abuts stop shelf 48. Inner tubing hanger member 37 has an external upward facing shoulder 49. While in the engaged position, shoulder 49 is below a lower end 50 of outer tubing hanger member 27. Inner tubing hanger member 37 can be lifted relative to outer tubing hanger member 27 without shoulder 49 abutting lower end 50. As will be explained subsequently, lifting inner tubing hanger member 37 while in the engaged position allows the operator to rotate inner tubing hanger member 37 to the disengaged position.

An inner seal 51 seals between the exterior of inner tubing hanger member 37 and bore 31 of outer tubing hanger member 27. A packoff 53 seals between the exterior of outer tubing hanger member 27 and wellhead housing bore 15. Inner seal 51 and packoff 53 may be a variety of types. In this example, a metal energizing member 55 is located on an elastomeric portion of packoff 53. Lock pins 57 extending radially through threaded holes in wellhead 13 have tapered ends that engage energizing member 55 to move it downward and set packoff 53.

Inner tubing hanger member 37 has an axially extending fluid passage 59 extending downward through its sidewall 40. An upper fitting 62 is located at the lower end of fluid passage 59. At a lower expanded region 38 of inner tubing hanger member 37, the outer diameter of inner tubing hanger member 37 is enlarged, increasing the thickness of sidewall 40 in the lower expanded region 38 relative to the thickness of sidewall 40 in an upper region 42 of inner tubing hanger member 37. Within the lower expanded region 38, fluid passage 59 has a cross drilling 60 so that fluid passage 59 below cross drilling 60 is located radially outward relative to the fluid passage 59 above cross drilling 60. Cross drilling 60 acts as a transition section of fluid passage 59 between the radially offset portions of fluid passage 59. Cross drilling 60 allows for fluid passage 59 above cross drilling 60 to be located in sidewall 40 a sufficient distance radially inward from the exterior of inner tubing hanger member 37. Fluid passage 59 cannot be located in the sidewall 40 too close to the exterior of inner tubing hanger member 37 because if there is insufficient sidewall material between fluid passage 59 and the exterior of inner tubing hanger member 37, the structural integrity of inner tubing hanger member 37 can be compromised.

A fluid line 61 secures to the lower end of inner tubing hanger member 37 and extends alongside production tubing 39 to deliver fluids into the well below the wellhead 13. A lower fitting 64 is located at the top end of fluid line 61. Lower fitting 64 can be a threaded connector that is located at a standard, predetermined distance radially outward from axis 32. Fluid line 61 may be connected to a downhole safety valve (not shown) that closes the passage within production tubing 39 if hydraulic fluid pressure is lost. Fluid line 61 can also be used for injecting fluid into the well such as inhibitors for preventing wax deposits. Below cross drilling 60, the fluid passage 59 can be located at the required distance radially inward from the exterior of inner tubing hanger member 37 so that the upper fitting 62 can be a threaded connector that mates with the lower fitting 64, which is also a threaded connector, to provide fluid communication between the fluid passage 59 and fluid line 61.

An adapter cap 63 may be mounted on the upper end of inner tubing hanger member 37, which protrudes above inner tubing hanger member 27 and wellhead 13. Adapter cap 63 seals between inner tubing hanger member 37 and a bore in a tubing head 65 bolted to the upper end of wellhead 13. Tubing head 65 has a fluid passage 67 extending through its sidewall that registers with fluid passage 59 in inner tubing hanger member 37 when tubing head 65 is installed. Adapter cap 63 has a port 66 which extends through its sidewall to provide fluid communication between fluid passage 59 in inner tubing hanger member 37 and fluid passage 67 of tubing head 65. Tubing head 65 has valves (not shown) for controlling well fluid flowing upward through inner tubing hanger member bore 41.

Figure 2:
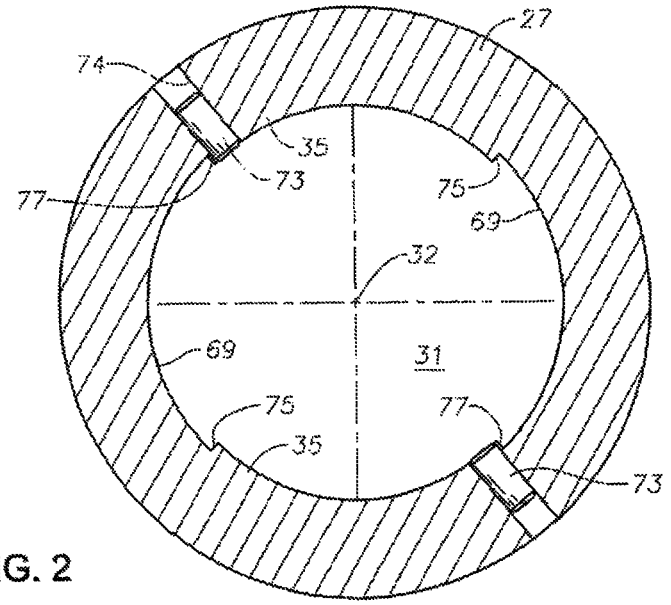
FIG. 2 is a horizontal sectional view of the outer tubing hanger member of the tension tubing hanger assembly of FIG. 1, taken along the line 2-2 of FIG. 1, and shown with the inner tubing hanger member removed.

Referring to FIG. 2, which illustrates only outer tubing hanger member 27 in horizontal cross-section, there are two shelves 35 spaced 180 degrees from each other at each axial level. The two shelves are located in the same plane perpendicular to axis 32. Each shelf 35 extends about 90 degrees in this example and has a cylindrical inner edge with a circumscribed diameter equal to the minimum diameter of bore 31. Two axially extending slots 69 are located between the two shelves 35 at each axial level, each slot 69 also extending circumferentially about 90 degrees. Slots 69 are cylindrical portions having a circumscribed diameter greater than the circumscribed diameter created by shelves 35. Slots 69 extend axially between each of the shelves 35 and continue downward, extending axially a lower end 50 of outer tubing hanger member 27.

Figure 3:
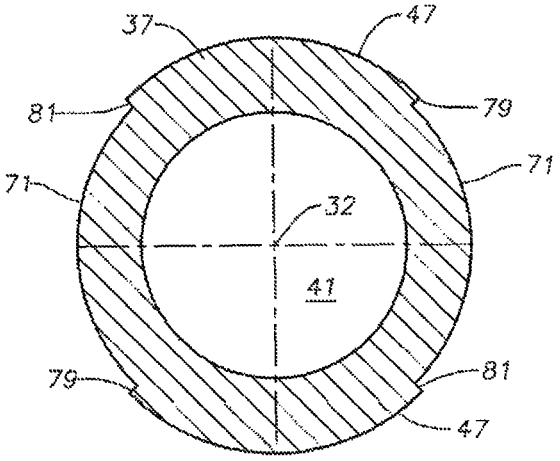
FIG. 3 is a horizontal sectional view of the inner tubing hanger member of the tension tubing hanger assembly of FIG. 1, also taken along the line 2-2 of FIG. 1, and shown removed from the outer tubing hanger member.

Referring also to FIG. 3, which is a horizontal sectional view of inner tubing hanger member 37 only, two flanges 47 are illustrated spaced 180 degrees from each other. Each flange 47 has an outer edge that is cylindrical and slightly less in circumscribed outer diameter than the circumscribed inner diameter of slots 69. The circumscribed outer diameter of each flange 47 is greater than the circumscribed inner diameter of each shelf 35 (FIG. 2). Each flange 47 has a flat lower side that is in a plane perpendicular to axis 32 so that it will overlie one of the shelves 35. The circumferential extent of each flange 47 is less than the circumferential extent of each slot 69 so as to allow flanges 47 to move vertically within slots 69. Inner tubing hanger member 37 has two reduced diameter exterior portions 71 spaced 180 degrees opposite each other and located between flanges 47. Each reduced diameter portion 71 has a circumscribed inner diameter less than the circumscribed inner diameter of each shelf 35.

A torque pin 73 is mounted above at least one of the shelves 35. The dotted lines in FIG. 1 show a torque pin 73 mounted above each of the shelves 35 but the uppermost shelf 35. Each torque pin 73 extends radially through a hole 74 in the sidewall of outer tubing hanger member 27. Hole 74 may be threaded so as to secure torque pin 73 by rotation in a position protruding radially inward from groove 33 (FIG. 1). The inner end of each torque pin 37 protrudes to or slightly less than the circumscribed inner diameter of each shelf 35. Torque pins 73 thus do not protrude inward any farther than the minimum inner diameter of outer tubular member bore 31.

Each shelf 35 has a first end 75 and a second end 77 spaced about 90 degrees away. When viewed from above, as shown in FIG. 2, the direction of movement is left-hand or counterclockwise when proceeding from first end 75 to second end 77. Each torque pin 73 is mounted at or above second end 77 of each shelf 35. Similarly, when viewed from above as in FIG. 3, each flange 47 has a first end 79 and a second end 81 spaced less than 90 degree away. When proceeding from first end 79 to second end 81, the direction is left-hand or counterclockwise when viewed from above. When flanges 47 are spaced axially between shelves 35, rotating inner tubing hanger member 37 in a left-hand direction causes flanges 47 to move over shelves 35 until second ends 81 abut torque pins 73, blocking further left hand rotation of inner tubing hanger member 37.

Figure 4:
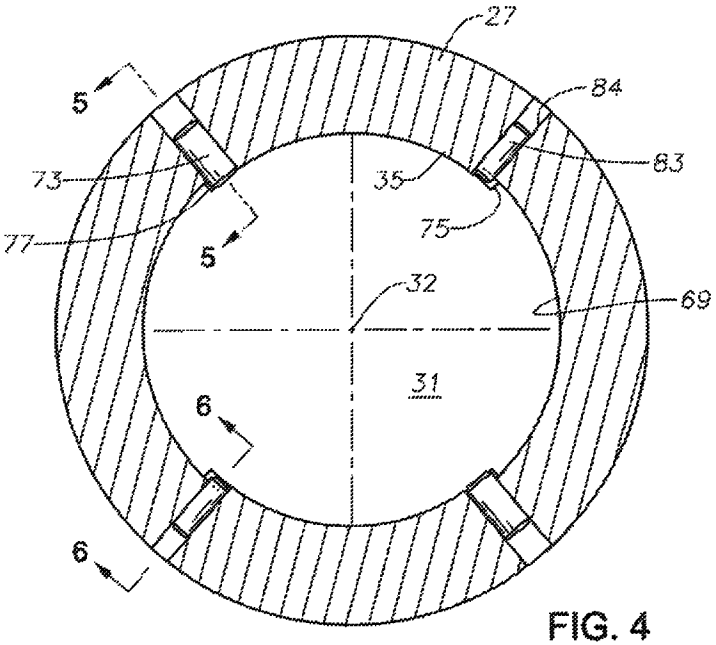
FIG. 4 is a horizontal sectional view of the outer tubing hanger member of the wellhead assembly of FIG. 1, taken along the line 4-4 of FIG. 1, and shown with the inner tubing hanger member removed.

Referring to FIG. 4, at least one detent pin 83 is mounted above at least one of the shelves 35. In this example, there are two detent pins 83 spaced 180 degrees apart from each other at the same axial point along outer tubing hanger member bore 31. The dotted lines in FIG. 1 illustrate that other detent pins 83 may be spaced axially from those shown in FIG. 4. Each detent pin 83 is located in a hole 84 extending radially through the sidewall of outer tubing hanger member 27. Hole 84 may be threaded so as to position each detent pin 83 in a position with its inner end protruding inward no farther than the protrusion of each torque pin 73. Each detent pin 83 is located above first end 75 of each shelf 35. Each detent pin 83 has a smaller diameter than each torque pin 73.

Figure 5:
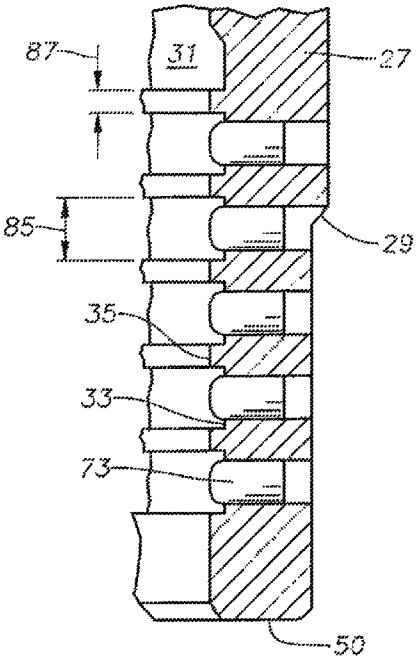
FIG. 5 is a vertical sectional view of a portion of the outer tubing hanger member, taken along the line 5-5 of FIG. 4, and shown with the inner tubing hanger member removed.

Referring to FIG. 5, the axial extent 85 of each groove 33 may be slightly greater than the diameter of each torque pin 73. The axial thickness 87 of each shelf 35 may be considerably less than groove axial extent 85. Each torque pin 73 is illustrated as being axially centered between two of shelves 35.

Figure 6:
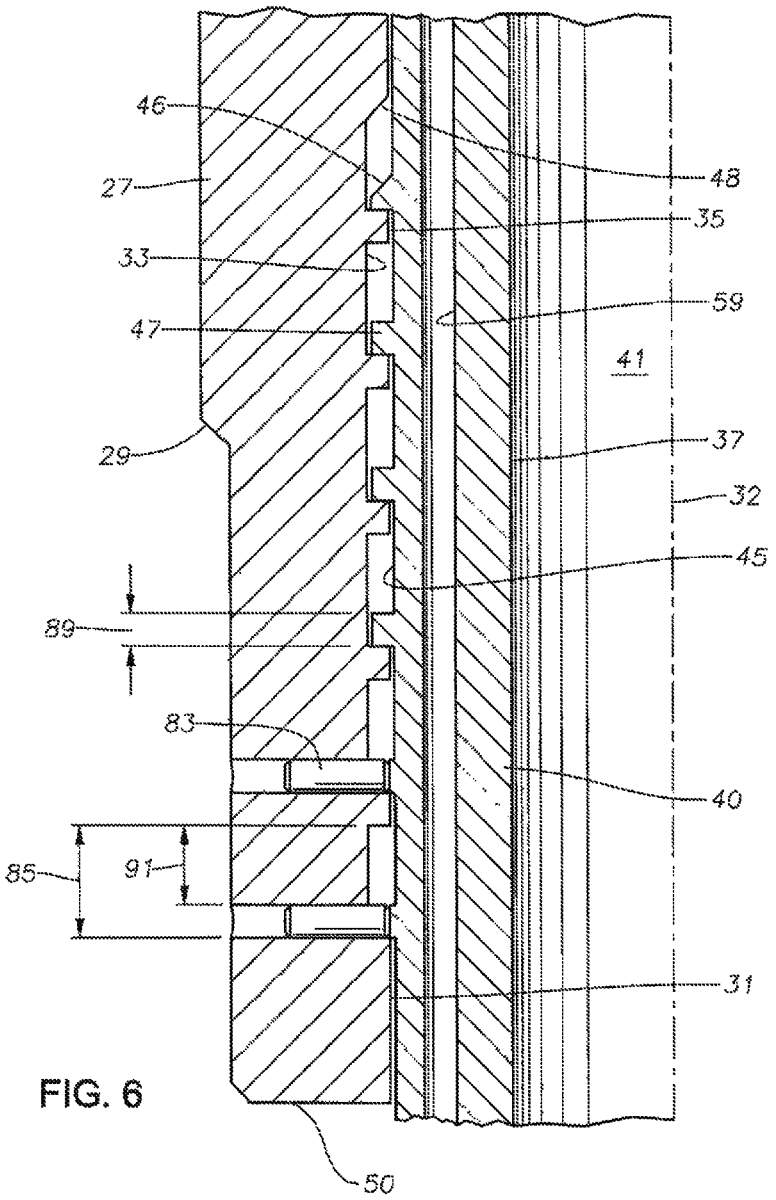
FIG. 6 is a vertical sectional view of a portion of the outer tubing hanger member, taken along the line 6-6 of FIG. 4, and shown with the inner tubing hanger member installed.

Referring to FIG. 6, the axial thickness 89 of each flange 47 is illustrated as being generally the same as the axial thickness 87 of each shelf 35 (FIG. 5), but it could differ. The flange axial thickness 89 is considerably less than the groove axial extent 85. In this example, flange axial thickness 89 is less than one-half groove axial extent 85. The diameter of detent pin 83 is about the same or no more than flange axial thickness 89. A lower side of detent pin 83 is flush with an upper side of shelf 35. A clearance distance 91 from the upper side of detent pin 83 to the lower side of the shelf 35 directly above is greater than the axial thickness 89 of each flange 47. Consequently lifting inner tubular member 37 until flanges 47 bump against the shelves 35 will position the lower side of flange 47 above detent pin 83.

Figure 7:
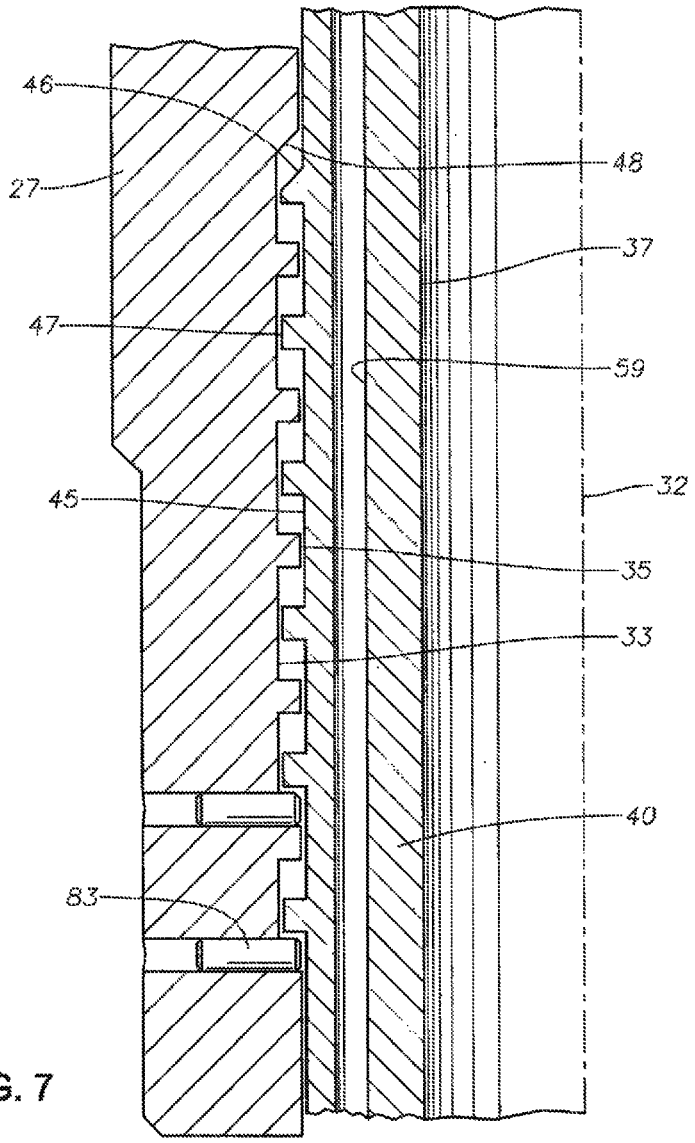
FIG. 7 is a vertical sectional view similar to FIG. 6, but showing the inner tubing hanger member lifted slightly relative to the outer tubing hanger member.

FIG. 7 shows inner tubing hanger member 37 lifted until the lower sides of flanges 47 are above detent pins 83. At this point, the operator may rotate inner tubular member in a first direction, or a right-hand or clockwise direction as viewed from above, to position flanges 47 in slots 69 (FIG. 2). When flanges 47 are aligned with slots 69, the operator can lower inner tubing hanger member 37 relative to outer tubing hanger member 27. When flanges 47 are resting on shelves 35, the first ends 79 (FIG. 3) will abut detent pins 83 (FIG. 6) to prevent inadvertent rotation of inner tubing hanger member 37 to the right. Inner tubing hanger member 37 has to be first lifted a short distance before flanges 47 will clear detent pins 83 to enable right-hand rotation of inner tubing hanger member 37 relative to outer tubing hanger member 27.

Figure 10:
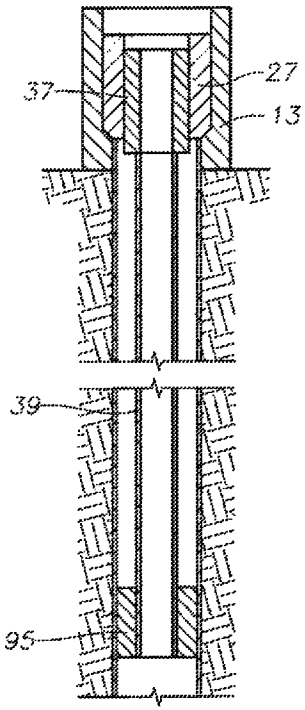
FIG. 10 is a schematic view of the wellhead assembly similar to FIG. 9, but showing the inner tubing hanger member back in engagement with the outer tubing hanger member and tension held in the production tubing.
Figure 9:
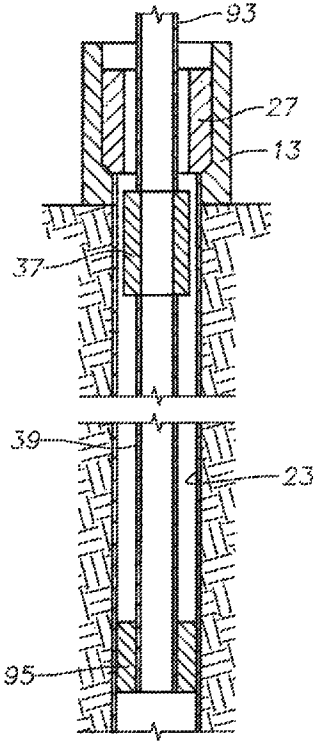
FIG. 9 is a schematic view of the wellhead assembly similar to FIG. 8, but showing the inner tubing hanger member lowered below the outer tubing hanger member to set the production tubing anchor.
Figure 8:
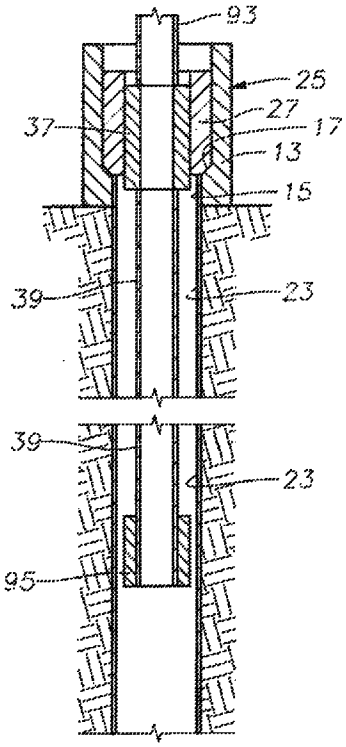
FIG. 8 is a schematic view of the wellhead assembly of FIG. 1, shown with the inner and outer tubing hanger members landed and an anchor on the production tubing not yet set.

An example of a method of using tubing hanger assembly 25 is illustrated schematically in FIGS. 8-10. The operator attaches a running tool 93 to profile 43 (FIG. 1) of inner tubing hanger member 37. A conventional device, such as a tubing anchor 95 is secured to a lower end of production tubing 39. Tubing anchor 95 will expand from a retracted position shown in FIG. 8 to an expanded position shown in FIGS. 9 and 10. In the expanded position, anchor 95 grips casing 23. The expansion may occur due to rotation of tubing 39, and a drag spring (not shown) may extend from anchor 95 to casing 23 to allow relative rotation of tubing 39 to anchor 95.

The operator assembles inner tubing hanger member 37 in an engaged position with outer tubing hanger member 27 and lowers tubing hanger assembly 25 as a unit. After outer tubing hanger member 27 has landed in wellhead 13, the operator may rotate lock pins 57 to set packoff 53, which prevents any axial movement of outer tubing hanger member 27 relative to wellhead 13. The operator then lifts inner tubing hanger member 27 a slight distance, as illustrated in FIG. 7 to place flanges 47 at a higher elevation than detent pins 83. Sloped upper surface 46 will abut stop shelf 48 when inner tubing hanger member 37 is lifted to the maximum extent relative to outer tubing hanger member 27. The operator then rotates about one-fourth turn to the right, which aligns flanges 47 with vertical slots 69 (FIG. 2). The operator than lowers inner tubing hanger member 37 a few feet until its upper end is spaced below outer tubing hanger member 27. Because slots 69 extend to the lower end 50 of outer tubing hanger member 27, inner tubing hanger member 37 can be completely disconnected from outer tubing hanger member 27. The operator then performs a function such as setting tubing anchor 95 by rotating inner tubing hanger member 37 and production tubing 39 relative to anchor 95.

Once anchor 95 is set, the operator lifts running tool 93 and inner tubing hanger member 37 while anchor 95 remains in gripping stationary engagement with casing 23. The lifting applies tension to production tubing 39. Some slight rotation of running tool 93 may be needed to align flanges 47 (FIG. 3) with vertical slots 69 during lifting. When sloped upper surface 46 abuts stop shelf 48, flanges 47 will be fully located within vertical slots 69 (FIG. 3), and the upward movement ceases. The operator then rotates running tool 93 in a second direction, to the left or counterclockwise, which causes flanges 47 to move between shelves 35, as illustrated in FIG. 7. The left hand rotation stops when second ends 81 (FIG. 3) abut torque pins 73. The operator continues applying left-hand rotation to running tool 93, which causes running tool 93 to unscrew from threads 43 (FIG. 1). Referring still to FIG. 1, once removed, the operator installs adapter cap 63 and tubing head 65.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A tubing hanger assembly, comprising:

a tubular outer tubing hanger member adapted to land in a bore of a wellhead, the outer tubing hanger member having a bore with an axis;

a tubular inner tubing hanger member having an engaged position in the bore of the outer tubing hanger member, the inner tubing hanger member adapted to be secured to a string of production tubing;

a retaining mechanism mounted to the outer tubing hanger member and the inner tubing hanger member for selectively allowing the inner tubing hanger member to be lowered relative to the outer tubing hanger member, after the inner tubing hanger member is moved from the engaged position to a disengaged position, then selectively allowing the inner tubing hanger member to be returned back to the engaged position, to create tension in the string of production tubing; and wherein the retaining mechanism operates in response to relative rotational movement between the inner tubing hanger member and the outer tubing hanger member the retaining mechanism comprising:

at least one shelf in the bore of the outer tubing hanger member, each shelf extending less than a full circumference, defining an axially extending slot; and at least one flange on the exterior of the inner tubing hanger member, each flange having a circumferential extent less than a circumferential extent of the slot so as to pass downward and upward through the slot when moving between the engaged position and the disengaged position.

2. The tubing hanger assembly according to claim 1, wherein:

the tubing hanger assembly further comprises a fluid passage extending axially within a sidewall of the inner tubing hanger member, the inner tubing hanger member has a greater sidewall thickness in a lower region than in an upper region, and wherein the fluid passage in the upper region is axially offset from the fluid passage in the lower region, the fluid passage in the upper region and the lower region being connected by a transition section of the fluid passage.

3. The tubing hanger assembly according to claim 1, wherein the retaining mechanism allows movement of the inner tubing hanger member from the engaged position to the disengaged position by rotation of the inner tubing hanger member less than one full turn.

4. The tubing hanger assembly according to claim 1, wherein:

the retaining mechanism allows movement of the inner tubing hanger member from the engaged position to the disengaged position in response to rotation of the inner tubing hanger member of less than one full turn in a first direction; and the retaining mechanism allows movement of the inner tubing hanger member from the disengaged position back to the engaged position in response to rotation of the inner tubing hanger member of less than one full turn in a second direction.

5. The tubing hanger assembly according to claim 1, further comprising:

a torque member located at a first end of the shelf that is engaged by a first end of the flange when rotating the inner tubular member to return the inner tubular member to the engaged position, the torque member defining a stop that limits an amount of rotational movement of the inner tubular member relative to the outer tubing hanger member.

6. The tubing hanger assembly according to claim 1, further comprising:

a detent pin located at a second end of the shelf that is engaged by a second end of the flange while the inner tubing hanger member is in the engaged position to deter rotational movement of the inner tubing hanger member while in the engaged position; and wherein lifting the inner tubing hanger member relative to the outer tubing hanger member provides a clearance for the second end of the flange to allow the inner tubing hanger member to be rotated from the engaged position to the disengaged position.

7. A wellhead assembly, comprising:

a tubular wellhead with a bore, a sidewall, and a fluid passage through the sidewall;

a tubular outer tubing hanger member landed in the bore of the wellhead, the outer tubing hanger member having a bore with an axis;

a tubular inner tubing hanger member having an engaged position in the bore of the outer tubing hanger member, the inner tubing hanger member having a sidewall;

an axial fluid passage extending axially within the sidewall of the inner tubing hanger member in communication with the fluid passage of the wellhead for delivering fluids below the wellhead assembly;

at least one shelf in the bore of the outer tubing hanger member, the shelf extending less than a full circumference, defining an axially extending slot;

at least one flange on the exterior of the inner tubing hanger member, the flange having a circumferential extent less than a circumferential extent of the slot; wherein the inner tubing hanger member moves from an engaged position to an unengaged position allowing the inner tubing hanger member to be lowered axially relative to the outer tubing hanger member when the inner tubing hanger member is rotated in a first direction relative to the outer tubing hanger member; and wherein the inner tubing hanger is returned to the engaged position when the inner tubing hanger member is raised axially relative to the outer tubing and rotated in a second direction relative to the outer housing tubing member.

8. The wellhead assembly according to claim 7, wherein the inner tubing hanger member has a greater sidewall thickness in a lower region than in an upper region, the wellhead assembly further comprising a fluid line extending downward from the wellhead, the fluid line having a threaded connector that mates with a threaded connector in the lower region of the inner tubing hanger member.

9. The wellhead assembly according to claim 7, wherein the inner tubing hanger member has a greater sidewall thickness in a lower region than in an upper region, and wherein the axial fluid passage in the upper region is axially offset from the axial fluid passage in the lower region, the axial fluid passage in the upper region and the lower region being connected by a transition section of the axial fluid passage.

10. The wellhead assembly according to claim 7, wherein the at least one shelf comprises a plurality of shelves spaced axially apart.

11. The wellhead assembly according to claim 7, wherein the at least one shelf comprises two shelves at each axial level in the bore of the outer tubing hanger member and the at least one flange comprises two flanges at each axial level on the exterior of the inner tubing hanger member.

12. The wellhead assembly according to claim 7, further comprising a torque member located at a first end of the shelf that is engaged by a first end of the flange and limits an amount of rotational movement of the inner tubing hanger member relative to the outer tubing hanger member when the inner tubing hanger member is moved in the second direction relative to the outer tubing hanger member.

13. The wellhead assembly according to claim 7, further comprising:

a detent pin located at a second end of the shelf that is engaged by a second end of the flange while the inner tubing hanger member is in the engaged position to deter movement of the inner tubing hanger member in the first direction relative to the outer tubing hanger member while in the engaged position; and wherein lifting the inner tubing hanger member relative to the outer tubing hanger member provides a clearance for the second end of the flange to allow the inner tubing hanger member to be rotated in the first direction relative to the outer tubing hanger member to move the inner tubing hanger from the engaged position to the disengaged position.

14. A method for supporting production tubing, comprising:

(a) positioning a tubular inner tubing hanger member in a bore of a tubular outer tubing hanger member in an engaged position to define a tubing hanger assembly;

(b) landing the tubing hanger assembly in a bore of a wellhead;

(c) causing relative rotation between the inner tubing hanger member and the outer tubing hanger member to operate a retaining mechanism and move the inner tubing hanger from an engaged position to an unengaged position, the retaining mechanism including:

at least one shelf in the bore of the outer tubing hanger member, each shelf extending less than a full circumference, defining an axially extending slot; and at least one flange on the exterior of the inner tubing hanger member, each flange having a circumferential extent less than a circumferential extent of the slot so as to pass downward and upward through the slot when moving between the engaged position and the disengaged position;

(d) lowering the inner tubing hanger member relative to the outer tubing hanger member, and (e) returning the inner tubing hanger member back to the engaged position and tensioning a string of production tubing that is secured to the inner tubing hanger member.

15. The method according to claim 14, wherein step (c) comprises rotating the inner tubing hanger member less than one full turn.

16. The method according to claim 14, wherein step (c) comprises rotating the inner tubing hanger member in a first direction and step (e) comprises rotating the inner tubing hanger member in a second direction.

17. The method according to claim 14, further comprising mating a threaded connector in a lower region of the inner tubing hanger member to a threaded connector of a fluid line that extends below the wellhead.

18. The method according to claim 14, wherein step (e) comprises rotating the inner tubing hanger member relative to the outer tubing hanger member until a torque pin of the retaining mechanism blocks further rotation of the inner tubular hanger member.

19. The method according to claim 14, wherein step (c) further comprises lifting the inner tubing hanger member relative to the outer tubing hanger member to provide a clearance for the retaining mechanism and allow the inner tubing hanger member to be moved from the engaged position to the disengaged position.

20. A wellhead assembly, comprising:

a tubular outer tubing hanger member having a bore with an axis;

a tubular inner tubing hanger member having an engaged position in the bore of the outer tubing hanger member, the inner tubing hanger member having a sidewall;

an axial fluid passage extending axially within the sidewall of the inner tubing hanger member for delivering fluids through the wellhead assembly;

at least one shelf in the bore of the outer tubing hanger member, the shelf extending less than a full circumference, defining an axially extending slot;

at least one flange on the exterior of the inner tubing hanger member, the flange having a circumferential extent less than a circumferential extent of the slot; wherein the inner tubing hanger member moves from an engaged position to an unengaged position allowing the inner tubing hanger member to be lowered axially relative to the outer tubing hanger member when the inner tubing hanger member is rotated in a first direction relative to the outer tubing hanger member; and wherein the inner tubing hanger is returned to the engaged position when the inner tubing hanger member is raised axially relative to the outer tubing and rotated in a second direction relative to the outer housing tubing member.

* * * * *